US006151466A

United States Patent [19]

Fujiwara

[11] Patent Number: 6,151,466

[45] Date of Patent: Nov. 21, 2000

[54] FIXING DEVICE INCLUDING VENTED CHAMBER-LIKE AREA

[75] Inventor: Hidehiko Fujiwara, Tokyo, Japan

[73] Assignee: Ricoh Company, Ltd., Tokyo, Japan

[21] Appl. No.: 09/379,838

[22] Filed: Aug. 24, 1999

[30] Foreign Application Priority Data

Aug. 24, 1998 [JP] Japan ..... 10-236668

[51] Int. Cl.[7] ..... G03G 21/20

[52] U.S. Cl. ..... 399/92; 399/94

[58] Field of Search ..... 399/69, 91, 92, 399/94, 122; 219/216

[56] References Cited

U.S. PATENT DOCUMENTS

| | | | |
|---|---|---|---|
| 5,307,133 | 4/1994 | Koshimizu et al. | 219/216 X |
| 5,390,006 | 2/1995 | Wakabayashi et al. | 219/216 X |
| 5,512,975 | 4/1996 | Kitsu et al. | 399/92 X |
| 5,768,655 | 6/1998 | Yoshino et al. | 399/69 |
| 5,787,319 | 7/1998 | Tomatsu | 399/69 X |
| 5,887,226 | 3/1999 | Taki | 399/92 |

FOREIGN PATENT DOCUMENTS

| | | |
|---|---|---|
| 5-134571 | 5/1993 | Japan . |
| 2838740 | 10/1998 | Japan . |

*Primary Examiner*—William J. Royer
*Attorney, Agent, or Firm*—Cooper & Dunham LLP

[57] ABSTRACT

A fixing device includes a fixing member that fixes a toner image to a recording sheet by heat, a cover to accommodate the fixing member, at least one partition member provided inside the cover so as to form a gap between the partition member and an internal circumferential surface of the cover, and an opening formed at a part of the cover above the gap.

9 Claims, 4 Drawing Sheets

FIXING DEVICE INCLUDING VENTED CHAMBER-LIKE AREA

BACKGROUND

1. Field of the Invention

The present application relates to a fixing device for use in an electrophotographic copying machine, a printer, a facsimile machine, or the like. More particularly, the present application relates to a fixing device capable of preventing undesirable effects on devices located around the fixing device.

2. Discussion of the Background

Image forming apparatuses, such as copying machines, facsimile machines, and printers, are provided with a fixing device to fix a toner image to a recording sheet. Generally, such a fixing device includes a heat roller having a fixing heater inside thereof and a pressure roller rotatably contacting the heat roller with pressure. The fixing device is configured to fix a toner image onto a recording sheet by application of heat generated by the fixing heater to the recording sheet while nipping and conveying the recording sheet with the heat roller and the pressure roller. Therefore, a temperature of devices located in the vicinity of the fixing device rises due to heat irradiated from the fixing device. As a result, for example, condensation of moisture occurs on cold parts of a main body of the copying machine. In addition, recording sheets tend to curl when heated by the radiated heat. In addition, when a drive motor is mounted adjacent the fixing device, undesirable effects on the drive motor may occur.

In recent years, because of the trend toward space-saving and compact-sizing of image forming apparatuses, the size of each device forming the image forming apparatus has become smaller and a distance between respective devices has tended to become shorter. Therefore, devices near the fixing device more easily receive the heat irradiated from the fixing device.

Generally, a fixing device is disposed adjacent to a toner reclaim tank which has a cleaning blade that contacts a photoconductor drum. Accordingly, when the temperature of the fixing device rises, the heat irradiated from the fixing device is transmitted to the toner reclaim tank and also to the cleaning blade. As a result, residual toner, which is contained in the toner reclaim tank, coagulates and residual toner which has adhered to an edge of the cleaning blade also coagulates. When the residual toner in the tank coagulates, it is hard for the toner reclaim tank to be fully filled with the residual toner. In addition, the coagulation of adhered toner at the cleaning blade results in deterioration in the cleaning properties of the blade, resulting in deterioration of image quality.

Japanese Laid-Open Patent Publication Tokukaihei 5-134571 describes a fixing device in which a partition member is disposed between a fixing device cover and cleaning/toner magazines to insulate the cleaning/toner magazines from heat irradiated from the fixing device cover.

However, in such a background fixing device, the temperature of the partition member rises relatively high because the partition member is located adjacent to the fixing device cover. Therefore, if an operator inadvertently touches the partition member by hand when removing a recording sheet jammed around the fixing device or when exchanging a photoconductor unit which is located close to the fixing device, for example, the operator may possibly be injured by the heated partition member.

In addition, because air which is heated by the heat generated by the fixing device remains in a small space in the fixing device cover, the temperature of the devices located around the fixing device is kept high for a long period of time even after power to the apparatus is turned off. Accordingly, the operator must wait a long period of time for the devices around the fixing device to cool off prior to removing the jammed recording sheet or exchanging the photoconductor unit.

SUMMARY OF THE INVENTION

The present invention has been made in view of the above-discussed problems and an object of the invention is to address and resolve these and other problems.

A preferred embodiment of the present invention provides a novel fixing device capable of preventing heat generated by a fixing heater from being transmitted to a fixing device cover and preventing air at high temperature in the fixing device cover from remaining in the cover.

A novel fixing device according to an embodiment of the present invention includes a fixing member that fixes a toner image to a recording sheet by heat, a cover to accommodate the fixing member, at least one partition member provided inside the cover so as to form a gap between the partition member and an internal circumferential surface of the cover, and an opening formed at a part of the cover above the gap.

The novel fixing device may further include an exhausting fan to exhaust air in the gap outside of the cover through the opening.

The exhausting fan may be provided outside of the cover, and a duct may be provided between the opening and the exhausting fan.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DESCRIPTION OF THE PREFERRED EMBODIMENTS

Figure 1:
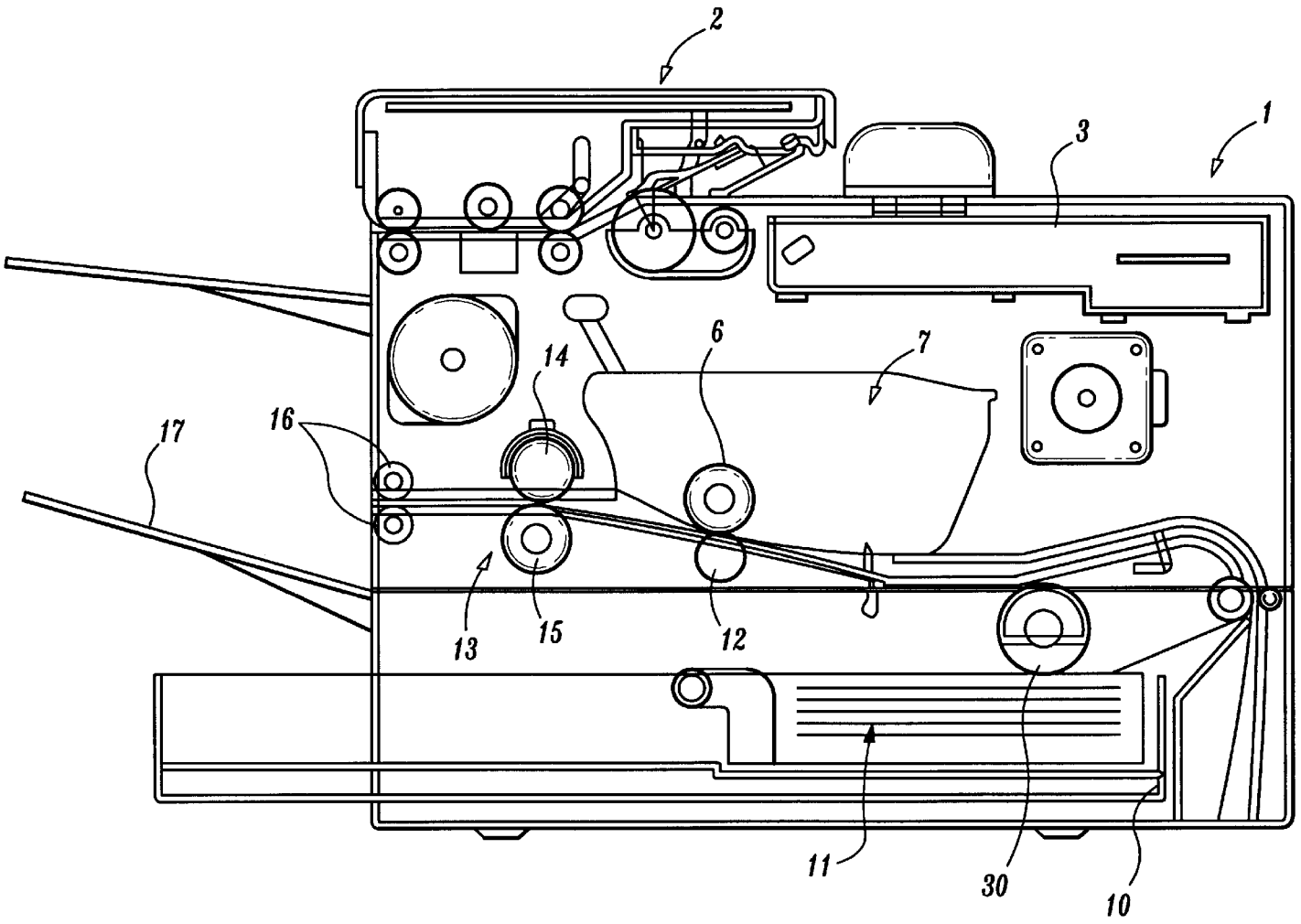
FIG. 1 is a schematic illustration of a copying machine having a fixing device according to the present invention.

The preferred embodiments of the present invention are now described in detail referring to the drawings, wherein like reference numerals indicate identical or corresponding parts throughout the several views.

FIGS. 1 to 4 are illustrations of a fixing device according to an embodiment of the present invention, in which the fixing device is applied to a copying machine. Of course, the fixing device can also be applied to other types of image forming apparatuses, such as, for example, facsimile machines and printers.

Figure 2:
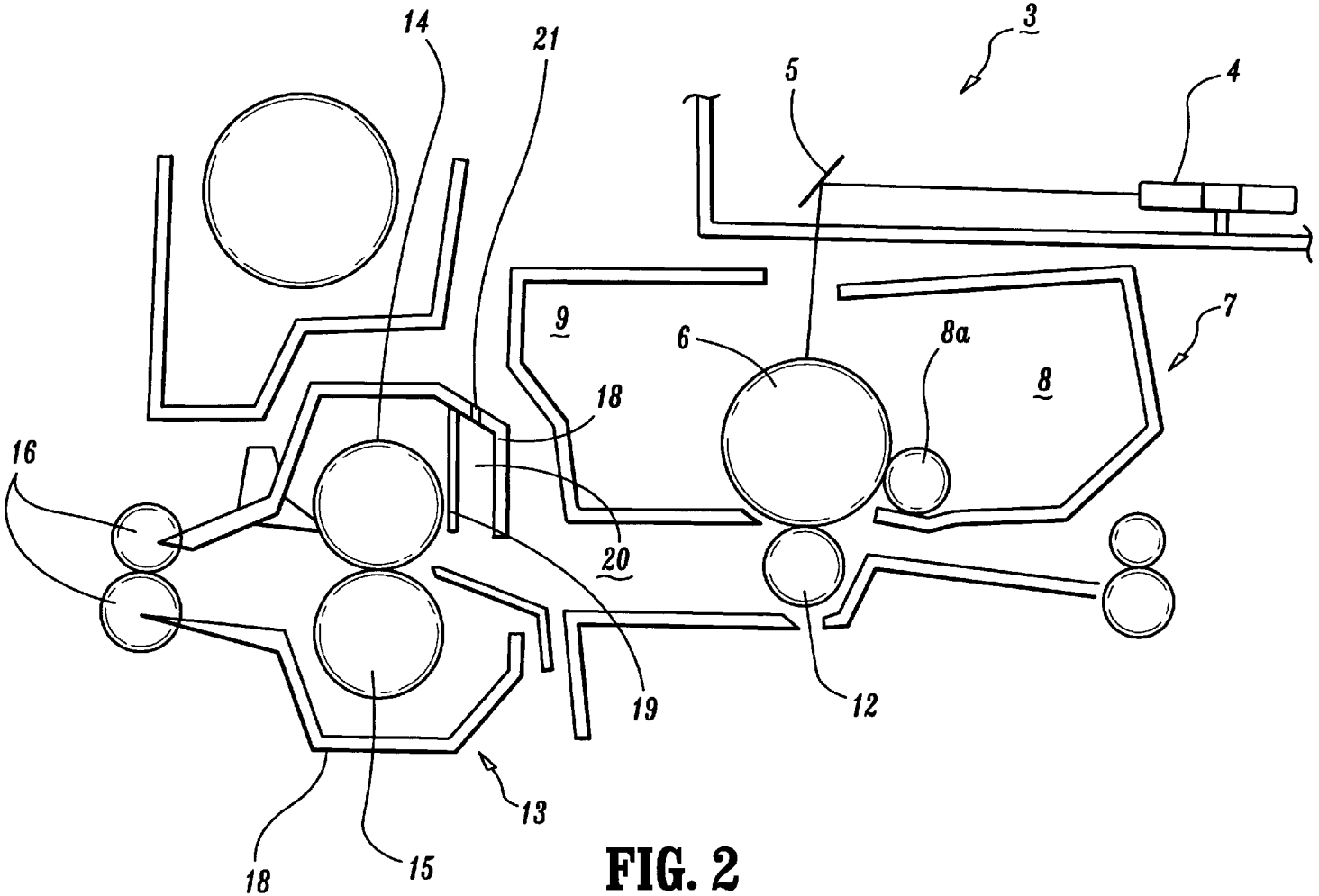
FIG. 2 is a schematic illustration of the fixing device according to the present invention.

A configuration of the copying machine is first explained referring to FIG. 1. A copying machine 1 includes an automatic document feeder 2 mounted thereon. The automatic document feeder 2 conveys a document to a reading section 3. As shown in FIG. 2, reading section 3 reads an image of a document and irradiates a photoconductor drum 6 with light modulated according to read image information via a polygon mirror 4 and a reflecting mirror 5.

A surface of the photoconductor drum 6 is first charged by a charging device (not shown) and an electrostatic latent image is formed on the charged surface of the photoconductor drum 6 by the light from the reading section 3.

A developing device 7 disposed around the photoconductor drum 6 includes a toner tank 8 and a toner reclaim tank 9 which are formed in a body. Toner that is contained in the toner tank 8 is supplied to the photoconductor drum 6 with a roller member 8*a* to develop the electrostatic latent image formed on the photoconductor drum 6.

Referring again to FIG. 1, a recording sheet 11, which is contained in a sheet-feeding cassette 10, is supplied toward the photoconductor drum 6 by a sheet-feeding roller 30. The recording sheet 11 is conveyed to a nip portion between the photoconductor drum 6 and a transfer roller 12 and a toner image on the photoconductor drum 6 is transferred onto the recording sheet 11 by application of a voltage to the transfer roller 12 by a power pack (not shown). The toner reclaim tank 9 has a toner reclaim blade and a toner reclaim roller (not shown). A residual toner that adheres to the photoconductor drum 6 is reclaimed in the toner reclaim tank 9 by the toner reclaim blade and the toner reclaim roller.

A fixing device 13 is provided adjacent the toner reclaim tank 9 and close to the photoconductor drum 6. The fixing device 13 includes a fixing member composed of a heat roller 14 having a fixing heater inside thereof and a pressing roller 15 rotatably contacting the heat roller 14 with pressure. The fixing device 13 is configured to fix a toner image on a recording sheet 11 by application of heat to the toner image while nipping and conveying the recording sheet 11 between the heat roller 14 and the pressing roller 15. The recording sheet 11 is discharged to a sheet-discharging tray 17 by a pair of sheet-discharging rollers 16 after the toner image has been fixed onto the recording sheet 11.

As illustrated in FIG. 2, the heat roller 14 and the pressing roller 15 are accommodated in a molded fixing device cover 18, and a partition member 19 made of sheet metal is disposed inside the fixing device cover 18. The partition member 19 may be made of a material other than metal.

Figure 3:
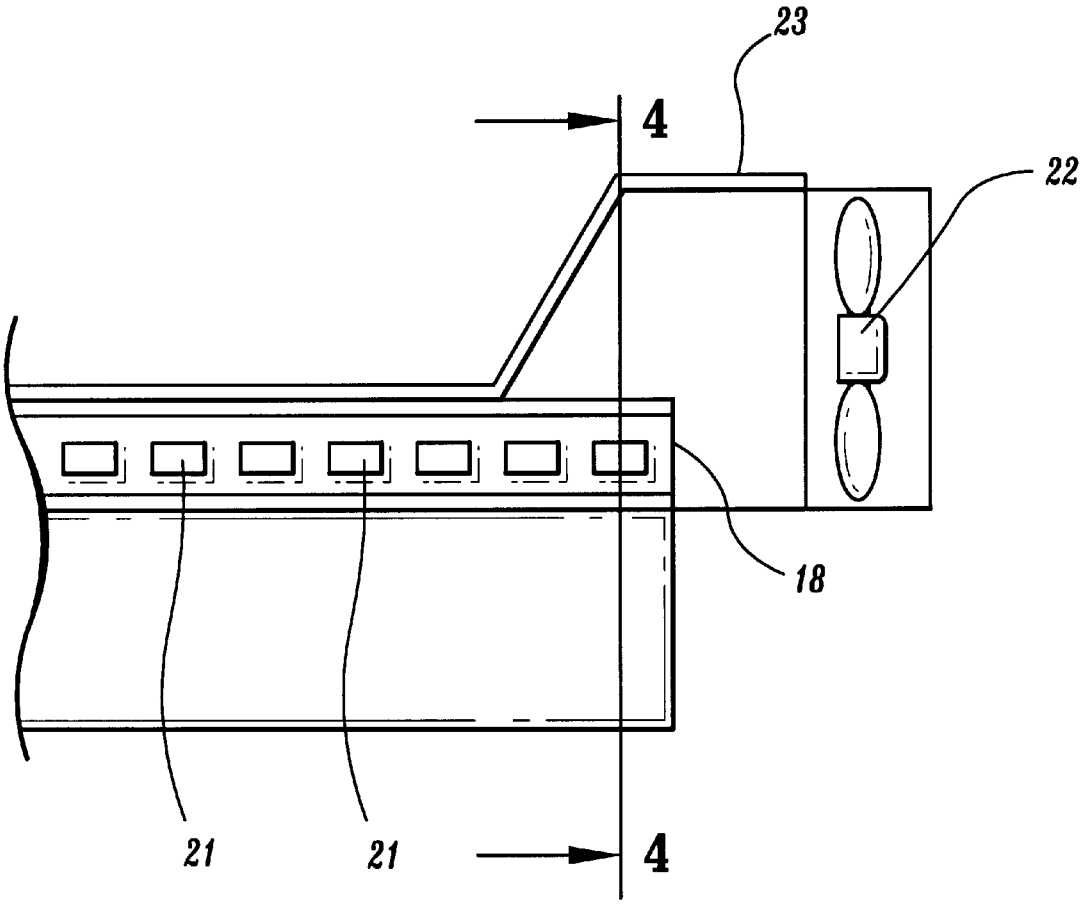
FIG. 3 is a schematic illustration of the vicinity of openings of the fixing device.
Figure 4:
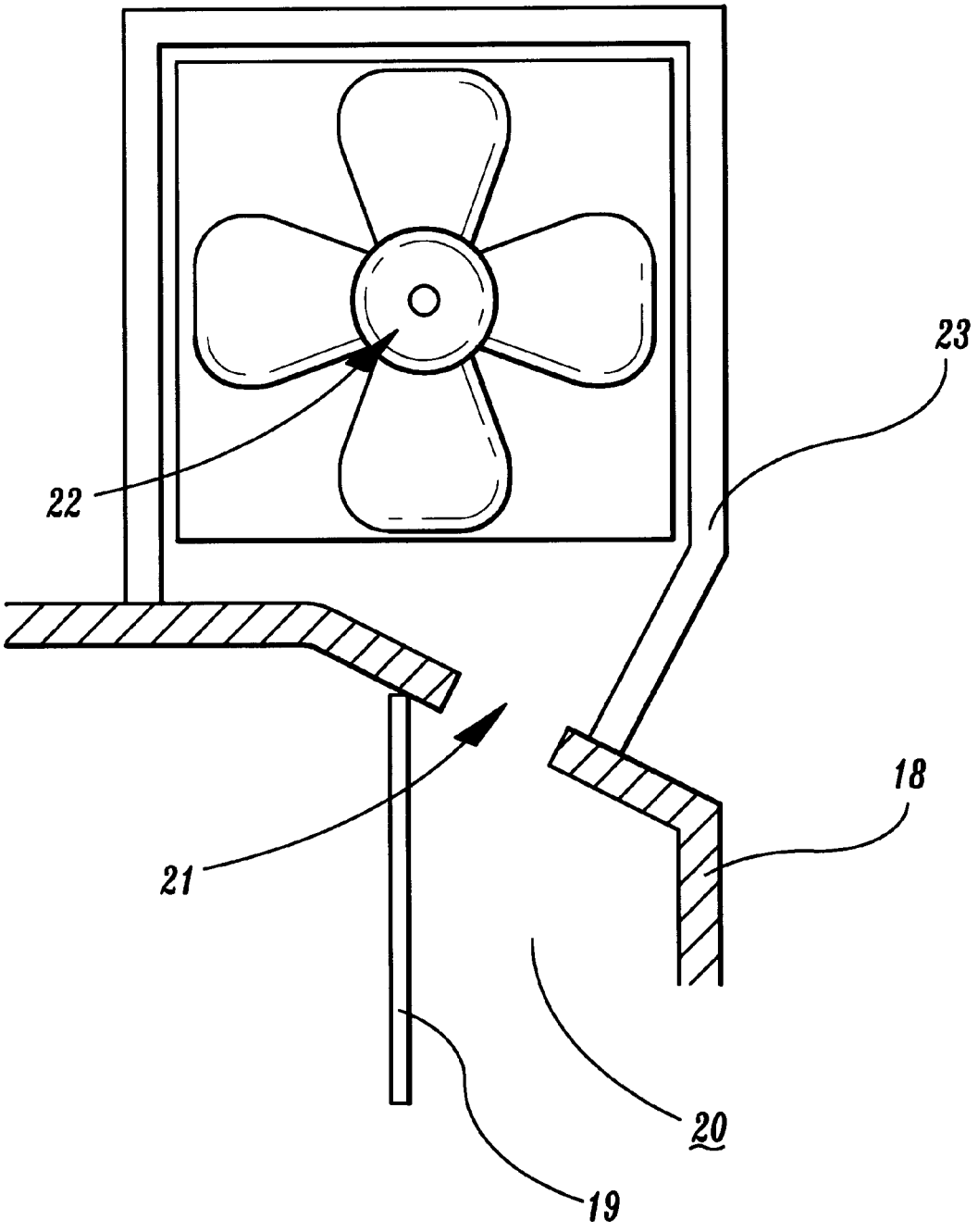
FIG. 4 is a cross-sectional view taken along line 4—4 in FIG. 3.

The partition member 19 is disposed so as to form a gap 20 between the partition member 19 and an internal surface of the fixing device cover 18 that opposes the toner reclaim tank 9. The gap 20 forms a chamber-like area between the partition member 19 and the internal surface of the fixing device cover 18. A plurality of openings 21 are formed in the fixing device cover 18 above the gap 20. Furthermore, as illustrated in FIGS. 3 and 4, an exhausting fan 22 is provided outside of the fixing device cover 18 and the exhausting fan 22 and the openings 21 communicate with each other by a duct 23. The exhausting fan 22 is mounted on a main body cover of the copying machine 1. The exhausting fan 22 may be mounted at positions other than on the main body cover in the main body of the copying machine 1, preferably in positions where the heat from the fixing device 13 will not affect the fan much.

In the above embodiment of the present invention, the partition member 19 is disposed so as to form the gap 20 between the partition member 19 and the internal surface of the fixing device cover 18 that opposes the toner reclaim tank 9 and the plurality of openings 21 are formed in the fixing device cover 18 above the gap 20. The fan rotates in a direction to pull hot air from inside gap 20 through openings 21 and duct 23. Accordingly, the heat generated by the fixing heater can be prevented from being transmitted to the fixing device cover 18 by the partition member 19. Furthermore, the high temperature air in the fixing device cover 18 is exhausted through the openings 21 and does not remain in the fixing device cover 18. As a result, the temperature of the fixing device cover 18 can be prevented from rising too high. Therefore, a removing operation for removing a recording sheet, which is jammed in the fixing device 13, and an exchanging operation for exchanging a photoconductor drum unit located near the fixing device 13, can be easily performed by the operator.

In addition, the heat generated by the fixing heater does not reach the toner reclaim tank 9 where the residual toner is contained. Therefore, the coagulation of the residual toner adhering to an edge of a cleaning blade of the toner reclaim tank 9, which results in deterioration of image quality due to deterioration of cleaning properties of the photoconductor drum, can be prevented.

Furthermore, because the air in the gap 20 can be positively exhausted outward by the exhausting fan 22 through the opening 21, the relatively high temperature air can be prevented from remaining in the fixing device cover 18 and the heat remaining in the fixing device cover 18 can be effectively removed. As a result, the temperature of the fixing device 13 can be prevented from rising too high and the heat can be prevented from being transmitted to the toner reclaim tank 9 more effectively.

Furthermore, because the exhausting fan 22 and the openings 21 communicate with each other by the duct 23, the high temperature air that passes through the openings 21 is prevented from being scattered inside the main body of the copying machine 1 and is effectively exhausted outside of the fixing device cover 18. Thereby, the temperature of the fixing device 13 can be prevented from rising high and the heat generated by the fixing heater can be further prevented from being transmitted to the toner reclaim tank 9.

Although only one partition member 19 is provided in this embodiment, when a plurality of devices in the main body of the copying machine, such as, for example, a transfer device, a charging device, and the like, are disposed adjacent to the fixing device 13 in addition to the toner reclaim tank 9, the heat generated by the fixing heater can be prevented from being transmitted to these devices by disposing a plurality of partition members in the fixing device 13 at positions opposed to the plurality of devices, respectively.

Numerous modifications and variations of the present invention are possible in light of the above teachings. It is therefore to be understood that within the scope of the appended claims, the invention may be practiced otherwise than as specifically described herein.

This document claims priority and contains subject matter related to Japanese Patent Application No. 10-236668, filed on Aug. 24, 1998, and the entire contents thereof are herein incorporated by reference.

What is claimed is:

1. A fixing device to fix a toner image to a recording sheet, comprising:

a fixing member that fixes the toner image to the recording sheet by heat;

a cover to accommodate the fixing member;

at least one partition member provided inside the cover to provide a gap which forms a chamber-like area between the at least one partition member and an internal circumferential surface of the cover; and at least one opening formed at a part of the cover above the gap within the chamber-like area.

2. The fixing device according to claim 1, further comprising:

an exhausting fan to exhaust air in the gap outside of the cover through the at least one opening.

3. The fixing device according to claim 2, wherein the exhausting fan is provided outside of the cover and a duct is provided between the at least one opening and the exhausting fan.

4. A fixing device to fix a toner image to a recording sheet, comprising:

means for fixing the toner image to the recording sheet by heat;

means for accommodating the fixing means;

means for partitioning the accommodating means to provide a gap which forms a chamber-like area between the partitioning means and an internal circumferential surface of the accommodating means; and means for allowing air to pass through, formed at a part of the accommodating means above the gap within the chamber-like area.

5. The fixing device according to claim 4, further comprising:

means for exhausting air in the gap outside of the accommodating means through the air passing means.

6. The fixing device according to claim 5, wherein the exhausting means is provided outside of the accommodating means and a duct is provided between the air passing means and the exhausting means.

7. A method of fixing a toner image to a recording sheet, comprising steps of:

providing a fixing member for fixing the toner image to the recording sheet by heat, a cover accommodating the fixing member, and a partition member provided inside the cover to provide a gap which forms a chamber-like area between the partition member and an internal circumferential surface of the cover; and operating a fan to withdraw hot air from within the cover through an opening formed at a part of the cover above the gap within the chamber-like area.

8. The method according to claim 7, wherein the fan comprises an exhausting fan which is operated to exhaust air in the gap outside of the cover through the opening.

9. The method according to claim 8, wherein the exhausting fan is provided outside of the cover and exhausts the air in the gap through a duct provided between the opening and the exhausting fan.

* * * * *